US005460352A

United States Patent [19]

Calafi

[11] Patent Number: 5,460,352

[45] Date of Patent: Oct. 24, 1995

[54] STABILIZING AND REINFORCING DEVICE FOR VEHICLE RAISING JACKS

[75] Inventor: Salvador Calafi, Barcelona, Spain

[73] Assignee: Tub, S.A., Sant Just Desvern, Spain

[21] Appl. No.: 221,245

[22] Filed: Mar. 30, 1994

[30] Foreign Application Priority Data

Mar. 30, 1993 [ES] Spain ..... 9300871 U

[51] Int. Cl.[6] ..... B66F 3/12

[52] U.S. Cl. ..... 254/126

[58] Field of Search ..... 254/122, 124, 254/126, DIG. 1, DIG. 4

[56] References Cited

U.S. PATENT DOCUMENTS

| | | | |
|---|---|---|---|
| 5,118,083 | 6/1992 | Metzen | 254/126 |
| 5,217,206 | 6/1993 | Brosivs et al. | 254/126 |
| 5,275,378 | 1/1994 | Alten | 254/126 |

FOREIGN PATENT DOCUMENTS

| | | |
|---|---|---|
| 247051 | 12/1979 | Spain . |
| 9300303 | 8/1993 | Spain . |

*Primary Examiner*—Robert C. Watson
*Attorney, Agent, or Firm*—Michael J. Striker

[57] ABSTRACT

A vehicle raising jack has an arm with a stirrup, at least one flat front support portion, at least one arm to which the jack foot is pivotally connected and a nut in which the jack screw is threaded. The jack has an automatic stabilizing and reinforcing structure including a convex member, rotatably retained and supported on a transverse rod attached to the arm by a hook and by respective end flanges. The stirrup is pivotally supported on the convex member and carries a center plate member, located in front of the stirrup and under the flat front support portion thereof. The stirrup is provided with a downwardly projecting flap attached to the bottom of the plate member, in which there is mounted a spring attached at the other end thereof to the arm and holding the stirrup centered.

3 Claims, 2 Drawing Sheets

STABILIZING AND REINFORCING DEVICE FOR VEHICLE RAISING JACKS

BACKGROUND OF THE INVENTION

The present invention relates to an automatic stabilizing and reinforcing device for vehicle raising jacks, which is applicable to various types of mechanical vehicle raising jacks, such as "Y" jacks, parallelogram jacks with extended legs and others.

Various types of mechanical vehicle jacks are known.

An "Y" jack has a column having a ground support floor and a raising arm pivotally mounted to the column at an intermediate height thereon and having a generally channel-shaped end stirrup for supporting the vehicle. For this purpose the stirrup has respective flanges in the proximity of the corresponding edges of the underside of the body. The column and the arm are linked together by a screw which is threaded into a nut pivotally connected crosswise to the top of the column, while the front end of the screw is pivotally and rotatably connected to an intermediate point of the raising arm, or the nut could be pivotally arranged on the raising arm and the screw would be pivotally and rotatably attached to the top of the column closed to the rear end thereof. The rear end of the screw is provided with a crank or the like enabling the user to operate the mechanical arm for raising the vehicle and thus be able to replace the corresponding faulty wheel.

A parallelogram jack has four hingedly connected arms and a screw arranged on the diagonal thereof. One of the ends of the screw is threaded in a nut arranged on one of the apexes of the parallelogram, while the other end is attached to the opposite apex, but rotatably. A portion of the screw juts outward for operation by a crank and in the "Y" jack. In this jack the lower apex of the parallelogram has pivotally attached thereto a ground support plate acting as a foot, and the upper apex of the parallelogram has attached thereto another plate acting as a stirrup for supporting the corresponding part of the vehicle.

Another jack has a mechanism with four hingedly connected arms arranged in the form of a parallelogram provided with a screw situated on a diagonal as the above described parallelogram jack, and which is approximately horizontal when the jack is in the position of use. It is operated by a crank or the like. The front end of the screw is threaded in a nut pivotally mounted to the front apex of the parallelogram, while the opposite end of the screw passes through a cross member which is pivotally connected to the rear apex of the parallelogram. The rear end of the screw is terminated in a rear expansion which is rotatably supported against the cross member. A bearing is located preferably intermediately to facilitate the rotary support. The relative position of the rotary support and the nut can be reversed. This jack is provided with a stirrup close to the upper apex of the parallelogram on an extension of the rear upper arm. Characteristically the rear lower arm of the parallelogram extending from the rear apex is extended downwardly forming a jack support leg which is pivotally attached in turn to a ground support foot.

The known jacks of different types provide different advantages making them particularly useful for particular applications in accordance with technical requirements of the manufacturers of the corresponding vehicles. However, there is a general problem with regard to the raising jacks as to their use by normal user who is not specifically versed in this field even in the event of the correct use of the jack to replace a defective wheel of a vehicle. This problem consists of ensuring the stability of the structure formed by the jack and the vehicle when the jack is being used, and also of withstanding mechanical effort required by the vehicle manufacturer in corresponding conditions.

It is known that mechanical jacks for raising vehicles have a support for the underside of the vehicle to be raised. The support is known as an above mentioned stirrup and in some cases it is fixed, i.e. is firmly attached to the end of the bearing arm and in other cases it is pivotally mounted about a horizontal pin at the end of the arm which forms the pivot pin for the stirrup for better adaptation to the vehicle body during lifting and lowering operations with the mechanical jack. When the stirrup rotates relative to the bearing arm about a pivot pin which is parallel to the axis of pivoting of the arm, it is known to arrange the pivot pin at a certain distance from the support plane of the vehicle body. In accordance with a further embodiment the pivot point is supported directly alongside the underside of a first support portion with the stirrup so that the distance between the pivot point and the lower surface of the vehicle body is determined only by the thickness of the stirrup portion.

The known stirrups are normally provided, in addition to the flat portion, with a "U" or "V" shaped recess or channel in which a lower flange on the underside of the vehicle body, reinforced to withstand the mechanical stress resulting from being supported on the jack stirrup while the vehicle is being raised or lowered, may be freely housed. The flange serves to guide the jack stirrup both when being placed below the body and when being raised or lowered and to prevent untimely slipping without it reaching down against the bottom of the stirrup channel.

A "Y" type vehicle raising jack is disclosed in the Utility Model number 247,051, in which the pivot pin of the support plate or stirrup bears directly against the lower side thereof and is arranged approximately horizontally with the projecting formation of the vehicle body floor, i.e. of the underside of the vehicle body where the jack stirrup is placed and adjusted.

A jack having a stirrup pivotally mounted on the end of the bearing arm, by way of a pivot pin parallel to the axis of pivoting, may adapt itself better to the relative movement between the vehicle body and said jack, than in the case of a jack having its stirrup fixed relative to the bearing arm thereof. Nevertheless, there are vehicles today where the simple rotation of the jack relative to the bearing arm thereof is not sufficient for the specific suspension, which at times even has a differentiated behavior between the front wheel suspension and the rear wheel suspension of said vehicles, but rather they require the stirrup to have various degrees of freedom, i.e., various movements to be able to adapt itself suitably to the complex movement of said vehicles when they are being raised or lowered with a mechanical jack, because the suspension gives way in one or another direction other than the one imposed by the mere rotation about a transverse axis relative to the stirrup bearing arm. Furthermore, the vehicle manufacturers require the jacks to be mechanically stronger, partly because of the greater weight of such vehicles derived from the increase of their passive safety (body reinforcement, internal complements, etc.). It implies a corresponding reinforcement of the parts of interest of the jack, which is not achieved with the known jacks, unless on the basis of increasing the weight thereof excessively, with a corresponding increase in cost.

A stabilizing and reinforcing device for vehicle raising jacks is proposed by the applicant in the Utility Model number 9,300,303. The device disclosed there has an arm provided at the end thereof with a stirrup for supporting the vehicle and having the form of a transverse channel with at least a flat front support portion, an arm or column to which the jack foot is pivotally connected and a nut in which the jack screw is threaded. This device is characterized in that the stirrup is provided, at the front support portion thereof, with three downwardly directed projections, one in the center and the other equidistant therefrom, transversely aligned close to the channel and spaced apart from the respective side edges of said front support portion of the stirrup. The projections bear against a transverse rod of a length slightly greater than the spacing between the two equidistant projections and attached to the end of the stirrup bearing arm. The latter has attached thereto a central plate member of a width slightly smaller than the spacing between the two upright walls of the end of the bearing arm and has two facing parallel plates, connected by an intermediate plate, forming a lower tubular central portion situated before the front wall of the stirrup channel and under the front support portion, determining a central recess by which said stirrup if freely pivotally connected to the rod, with a substantial clearance. The stirrup channel is provided with a center front cutout tab which is directed downwardly and to which there is attached the lower portion of the plate member, also directed downwardly and arranged below the recess. There is attached to said lower portion of the plate member the end of a central spring, the opposite end of which is attached to the stirrup bearing arm, keeping the latter centered against the rod in a preset position. The foot is provided with a central recess in which there is located the corresponding lower portion of the arm or column carrying the foot. The recess is crossed, just above, by a transverse rod attached at the front end thereof to the foot and to which the arm is pivotally connected, a spring being disposed between the foot and arm.

The device provides, among others, the advantages of increasing the degree of stability of the jack, reinforcing it at mechanically critical parts thereof and making it easier for the user initially to install the jack under the vehicle body.

SUMMARY OF THE INVENTION

Accordingly, it is an object of the present invention to provide a stabilizing and reinforcing device for vehicle raising jacks, which overcomes the drawbacks and defects of the known mechanical jacks.

In keeping with these objects and with others which will become apparent hereinafter, one feature of the present invention resides, briefly stated, in an automatic stabilizing and reinforcing device for vehicle raising jacks of the type comprising an arm having at the end thereof a stirrup for supporting the vehicle and having the form of a transverse channel with at least one flat front support portion, at least one arm or column to which the jack foot is pivotally connected and a nut in which the jack screw is threaded. This device is characterized in that it is provided with an upwardly convex member, capable of rotating relative to a transverse rod attached to the end of the stirrup bearing arm, which member bears against the rod and is rotatably retained thereon by at least one hook-like member arranged around the rod and by respective end flanges overlapping the corresponding ends of the rod; the stirrup is fitted upon and around the convex member, with a substantial clearance in transverse planes relative to the bearing arm thereof and bears on the convex portion of the member, about which it may rock in the planes; furthermore, the stirrup has attached thereto a center plate member having a width smaller than the gap between two vertical walls of the end of the bearing arm thereof, forming a lower tubular central portion, situated in front of the front wall of the stirrup channel and below the flat front support portion thereof, forming a large central recess for the convex member so that the stirrup may rock freely relative thereto on the planes; the stirrup channel is provided with a center front cutout tab, extending downwardly and to which there is attached the lower portion of the plate member, likewise directed downwardly and arranged below the recess; the end of a central spring is attached to the lower portion of the plate member, the opposite end of which is attached to the stirrup bearing arm, keeping the latter centered against the convex member in a preset position; and the foot is provided with a central recess in which there is located the corresponding lower end of the foot carrying arm or column, which recess is crossed, just above, by a transverse rod attached to the front end of the foot and to which said arm is pivotally attached, a spring being arranged between the foot and arm. It is also characterized in that the upwardly convex member is provided with at least one downwardly directed protuberance from the convex portion thereof, which bears on the transverse rod.

The new automatic stabilizing and reinforcing device may be applied to any of the known types of jacks or to any future type having corresponding parts or means.

The automatic stabilizing and reinforcing device for vehicle raising jacks of this invention, further to the advantages inherent in the stabilizing and reinforcing device disclosed in Utility Model number 9,300,303, provides among others, the following advantages: it provides for a more uniform distribution of the load transmitted by the stirrup to the transverse rod attached to the end of the bearing arm, with a progressive transverse rocking or rotation of the stirrup, further to achieving that the upwardly convex member has a relatively high mechanical strength, both because of the very convex configuration and for having one or more downwardly directed projections forming corresponding reinforcing ribs.

The inventive device offers the advantages that will be easily deduced from the embodiment of the device described in further detail below to facilitate an understanding of the above described features, disclosing at the same time various details. For this purpose, the specification is accompanied by drawings in which, only as an example not limiting the scope of the invention, there is shown one practical embodiment of the automatic stabilizing and reinforcing device for vehicle raising jacks.

5; and

Figure 1:
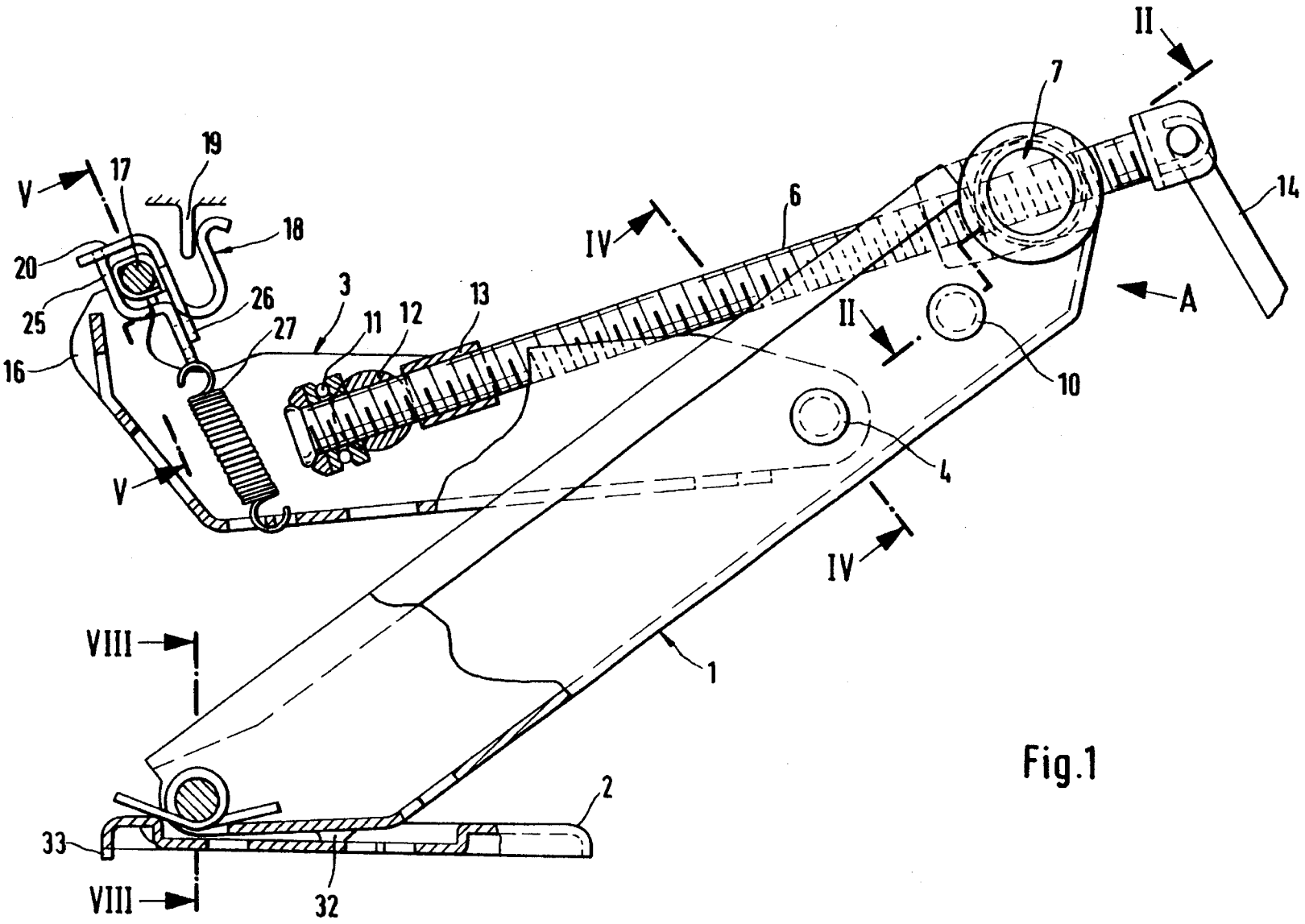
FIG. 1 is a side elevation view of the jack, starting the unfolding thereof beneath the vehicle body (shown schematically in part)
Figure 8:
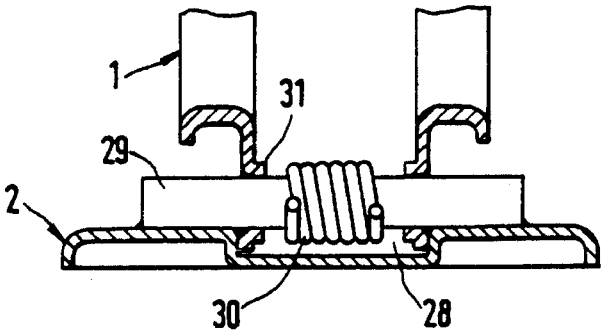

FIG. 8 is a cross-section view on the line VIII—VIII of FIG. 1, showing the lower portion of the jack where it rests on the floor.

DESCRIPTION OF THE PREFERRED EMBODIMENTS

Figure 2:
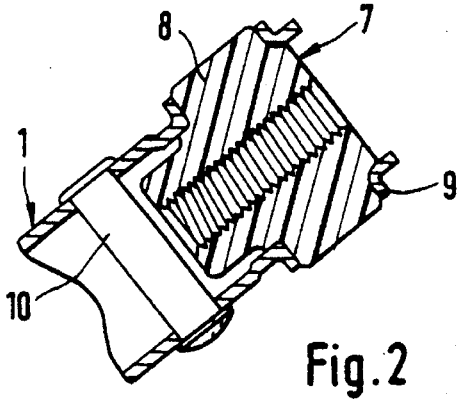
FIG. 2 is a cross-section view on the line II—II of FIG. 1, showing a detail of the assembly of the nut.
Figure 4:
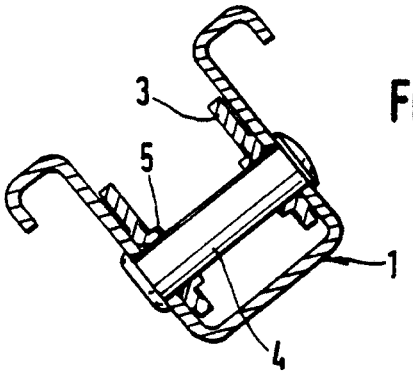
FIG. 4 is a cross-section view on the line IV—IV of FIG. 1, showing the pivotal connection between the stirrup bearing arm and the column.

A "Y" type jack shown in the drawings has a column 1 (which in the case of a parallelogram type jack would be one arm or an extension in form of a leg). A foot 2 is attached to the column 1 for supporting the jack on the ground, and a raising arm 3 carrying a stirrup is pivotally connected with the column at an intermediate point. The pivotal connection is formed by a pin 4 and two cylindrical swagings 5 provided on the raising arm as shown in FIG. 4 which reinforce this part of the arm and determine a larger support surface in its pivotal connection to the column 1. The column 1 and the raising arm 3 are connected with one another by a screw 6 threaded through a nut 7 shown in FIGS. 1 and 2. The screw has two opposite transverse trunions 8 inserted in respective 5 cylindrical swagings 9 in the column 1, so that the nut and therefore the screw 6 can rock. The cylindrical swagings form a reinforcement for the column in this part and a larger support surface for the nut.

At a position close to the nut 7 the column 1 is provided with a pin 10 which holds and retains two vertical walls of the U-shaped section of the column. Therefore any possible separation of the walls in the region of the nut is avoided and also any separation of the trunions 8 of the nut is avoided as well.

The screw 6 is supported in its front end by support means which include a bearing 11 shown in FIG. 1 or other suitable means to retain the front end of the screw in position and to facilitate its rotation relative to its transverse support. The transverse support is formed for example as a transverse shaft-like stop member 12 which is pivotally mounted in two vertical parallel walls of the raising arm 3 and against which the bearing 11 abuts. At the opposite portion a sleeve 13 is attached to the screw 6 and holds the arm 3 relative to the front end of the screw so as to form a stop member for the maximum raising of the arm 3 relative to the column 1. The relative position of the bearing or the like and the nut can be reversed. In other words the nut can be arranged in the plate corresponding to the shaft 12 and the bearing can be arranged abutting a pivotal transverse shaft-like stop member located in the place occupied by the nut 7 and between the shaft and the projecting rear portion of the screw.

A crank 14 is pivotally attached to the rear end of the screw 6 for enabling a user to rotate the screw backwards or forwards, i.e. to raise or lower the arm 3 with the stirrup and consequently the body of the vehicle to which it is applied. the crank 14 in this embodiment is pivotally connected inseparably to the rear end of the screw 6 and are stop members to set the operative positioning. The screw can be rotated by other means, and such means can have a separable or demountable connection between the crank or the like and the rear end of the screw.

Figure 3:
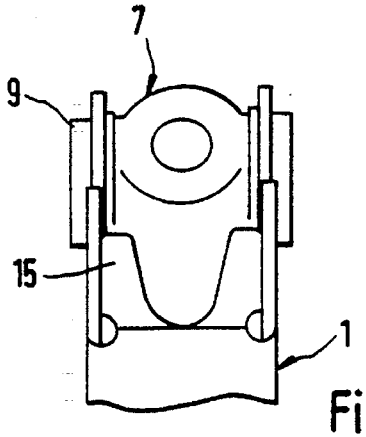
FIG. 3 is a view along the arrow A of FIG. 1.

The column 1 is generally U-shaped and has free ends folded in U in opposite directions as shown in FIG. 4. At the upper end of the column the web of the U section is partially extended following the oblique cut of this end so as to form two tabs 15 shown in FIG. 3. This prevents the vertical walls of the section in this part of the column from moving together and therefore avoids them pressing on the nut 7. This prevents a greater force that this would imply because of a certain breaking effect on the nut and also avoids any possible deterioration of the nut because of such action. The lower end of the column is also provided with a similar arrangement so that the web of the section is extended and folded along the oblique cut of the lower end and is inserted between the two side walls of the column preventing them from moving together or in other words keeping them in the correct position. It is to be understood that this particular section of the column can be made differently with the mechanical strength required for its function, including an embodiment formed by two parts.

Figure 5:
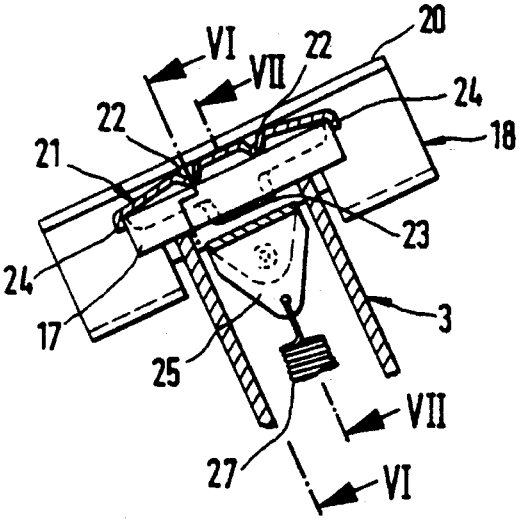
FIG. 5 is a cross-section view on the line V—V of FIG. 1, showing the stirrup and the assembly thereof.

The raising arm 3 is formed as a U-shaped section, but it can be of any other shape of sufficient mechanical strength. Its free end is cut obliquely, so that the web of the section extends in a bent fashion between two vertical walls of the section and is welded at the end. The walls form respective upward extensions 16, and a transverse rod 17 is welded to the top end of the extensions as shown in FIGS. 1 and 5. The stirrup 18 serves to support the vehicle to which the mechanical jack is applied. The stirrup has the shape of a transverse channel which has a U-shape in the shown embodiment, but can be of a V-shape or any other shape. The lower flange 19 provided on the underside of the vehicle body can be lodged in this channel. The stirrup is also provided with at least one front portion 20 which actually supports the vehicle body and is substantially flat for this purpose.

Figure 6:
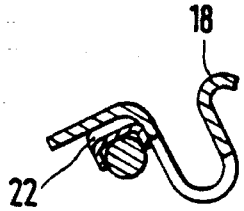
FIG. 6 is a cross-section on the line VI—VI of FIG. 5.
Figure 7:
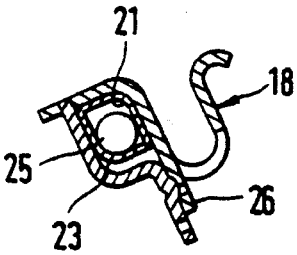
FIG. 7 is a cross-section view on the line VII—VII of FIG.

The device is further provided with an upwardly convex member 21 which can rotate relative to the transverse rod 17. The member 21 bears against the rod by projections 22, two in the shown embodiment, which are directed downwards from the convex portion of the member 21 bearing against the rod 17. The convex member 21 is retained on the rod by at least hook-like member 23 shown in FIGS. 5 and 7. The member 23 is displaced centrally and has end tabs 24 which overlap the corresponding ends of the rod 17 as shown in FIG. 5. Thus, the convex member 21 may rotate or rock to a certain extent around the axis formed by the rod 17, i.e. around a transverse axis relative to the raising arm 3 without moving in the transverse direction due to the tabs 24. The convex member abuts the rod by the projections 22 which in turn reinforce the convex member. The projections are oriented longitudinally, or in other words parallel to the longitudinal center line of the raising arm 3. This configuration of the convex member 21 facilitates its rotation relative to the rod 17. The projections 22 could be formed by swagings similarly to those shown in FIGS. 5 and 6 or by pieces or inserts fixed underneath the convex member 21.

The stirrup 18 has a plate member 25 which is attached to it by welding and has a width smaller than the gap between the two vertical walls of the end of the arm 3 carrying the stirrup. Therefore there is a here a transverse clearance allowing the stirrup to move in such direction relative to the bearing arm.

The stirrup is snugly mounted on and around the convex member 21 with a substantial clearance in transverse planes relative to the bearing arm 3 and rests against the convex portion of the member 21. It can rock relative to it in the transverse planes as can be seen from FIG. 5. The plate member 25 can be formed with two opposite parallel portions connected by an intermediate portion so as to assume a configuration of numeral four shown in FIG. 1. Therefore, it forms a lower central tubular portion located before the front wall of the stirrup 18 channel and below the flat front support portion 20. This tubular portion forms a central housing with a clearance for the convex portion 21 to allow the stirrup to rock freely relative to the convex member in the transverse planes relative to the stirrup bearing arm 3. The plate member 25 is attached at the lower portion by welding to a central front tab 26 which is cutout from the stirrup channel and extends downwards. The plate member 25 extends further down and has an orifice in which an end of a central spring 27 engages. The opposite end of the spring is attached to the base of the section of the stirrup bearing arm 3. Therefore when the stirrup is in the rest position it retains the latter centered relative to the rod and in a position predetermined by the situation of the lower fastening point of the spring to the arm it places the stirrup in its correct initial position to facilitate the positioning by the user when he offers the jack up to and places it under the vehicle body, apart from acting to eliminate the noise which the stirrup produces when the jack is stored in its place in the vehicle.

The above described construction of the unit formed by the stirrup 18 and the convex member 21 and its specific assembly relative to the transverse rod 17 allow the transverse clearance of the stirrup relative to the longitudinal center line of the raising arm 3, with a progressive tilting and with a joint rotation of the stirrup with its convex portion relative to the transverse rod. This facilitates the automatic adaptation of this part of the jack in which the corresponding portion of the vehicle body rests during its raising and lowering, allowing a correct support of the jack on the floor with a uniform distribution of the load transmitted by the stirrup to the transverse rod and with a progressive transverse rotation or rocking of the stirrup. At the same time a relatively high mechanical strength of the convex member is obtained, both for its very convex shape and for the downwardly directed projections which form corresponding reinforcement ribs for the convex member. The construction, the configuration and the arrangement of the unit formed by the stirrup 18 and the upwardly convex member 21 allows the stirrup to rock relative to an axis extending in a main median vertical plane of the jack, in combination with a rotation of the stirrup and convex member about the transverse axis formed by the transverse rod 17.

The foot 2 of the mechanical jack has a recess 28 shown in FIGS. 1 and 8. The recess is symmetrical about the longitudinal center line of the foot. It mechanically reinforces the foot and allows the transverse pivot pin 29 between the column 1 and the foot 2 to be as low as possible to increase the stability of the jack. A pin 29 is attached by welding to the foot 2 just above it and is provided with a spring 30 which is wound around the center portion of the pin. The ends of the spring bear resiliently against the bottom end of the column 1 and against the foot 2, holding the foot resiliently against the bottom of the column when the jack is not in use and the raising of the column relative to the ground support foot has not yet started, which also automatically predetermines an initial position of placement for the user and, at the same time, avoids noise when the jack is stored in the vehicle.

The column has two cylindrical swagings 31 reinforcing its two vertical walls at the joint with the foot and determining a large support surface for the column on the pin 21. The bottom end of the column 1 which in the initial position of the jack is located in the recess 28, can be provided with abutments 32 to position it relative to the bottom of the recess 28 of the foot. The foot can have tabs 33 for gripping the ground or for improving the adherence of the foot to the ground on which it is resting.

It will be understood that each of the elements described above, or two or more together, may also find a useful application in other types of constructions differing from the types described above.

While the invention has been illustrated and described as embodied in a stabilizing and reinforcing device for vehicle raising jacks, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A vehicle raising jack, comprising a jack foot adapted to be placed on a supporting surface; at least one column pivotally connected to said jack foot; a nut connected with said column; a jack screw threaded with said nut; an arm pivotally connected with said column and having an opposite end; a stirrup provided on said end for supporting a vehicle and formed as a transverse channel, said stirrup having a bearing arm with a transverse rod; an upwardly convex member rotatable relative to said transverse rod and bearing against the latter; at least one hook-like member by which said convex member is rotatably retained on said rod, said hook-like member being arranged around said rod and having end flanges overlapping corresponding ends of said rod, said stirrup being fitted upon and around said convex member with a clearance in transverse planes relative to said bearing arm and bears on a convex portion of said convex member about which it can rock in said planes; a center plate member attached to said stirrup and having a width smaller than a gap between two vertical walls of an end of said bearing arm so as to form a lower tubular central portion located in front of a front wall of said stirrup channel and below said flat front support portion so as to form a large central recess for said convex member and to allow said stirrup to rock freely relative to said convex member on said plane, said stirrup channel being provided with a center front cutout tab extending downwardly and attached to a lower portion of said plate member which is directed downwardly and arranged below said recess; a central spring attached to said plate member and said stirrup so as to keep said bearing arm of said stirrup centered against said convex member in a preset position, said foot being provided with a central recess in which a lower end of said column is located, said recess being crossed by a transverse rod attached to a front end of said foot and said arm being pivotally attached to said transverse rod, and a spring arranged between said foot and said arm.

2. A vehicle raising jack as defined in claim 1, wherein said central spring has one end attached to said lower portion of said plate member and an opposite end attached to said bearing arm of said stirrup.

3. A vehicle raising jack as defined in claim 1, wherein said convex member is provided with at least one downwardly directed protuberance extending from said convex portion and bearing on said transverse rod.

* * * * *